US007150104B2

(12) United States Patent
McKay et al.

(10) Patent No.: US 7,150,104 B2
(45) Date of Patent: Dec. 19, 2006

(54) TOOL AND METHOD FOR SCRIBING LONGITUDINAL LINES ON A CYLINDRICAL ROD

(75) Inventors: David B. McKay, Lakewood, OH (US); Darryl R. Bruck, Brook Park, OH (US); Edward L. Schwarz, Minneapolis, MN (US)

(73) Assignee: Electrolizing Corporation, Cleveland, OH (US)

( * ) Notice: Subject to any disclaimer, the term of this patent is extended or adjusted under 35 U.S.C. 154(b) by 0 days.

(21) Appl. No.: 10/955,971

(22) Filed: Sep. 30, 2004

(65) Prior Publication Data

US 2006/0064885 A1 Mar. 30, 2006

(51) Int. Cl.
*B43L 13/02* (2006.01)

(52) U.S. Cl. ..... 33/21.1; 33/32.1; 33/32.3

(58) Field of Classification Search ..... 33/18.1, 33/9.1, 19.2, 21.1, 32.1, 32.2, 32.3, 41.1, 33/41.6, 21.3, 32.5, 32.7, 19.1; 269/43, 246; 266/54

See application file for complete search history.

(56) References Cited

U.S. PATENT DOCUMENTS 1,907,956 A * 5/1933 Gerber ..... 266/54
1,942,118 A * 1/1934 Pignone ..... 33/32.2
2,311,234 A * 2/1943 Krajnc ..... 82/92
2,371,831 A * 3/1945 Leming ..... 269/246
2,438,229 A * 3/1948 Price ..... 33/373
2,546,110 A * 3/1951 Puterbaugh ..... 33/833
2,702,393 A * 2/1955 Merton ..... 470/80
2,796,899 A * 6/1957 Biro ..... 269/160
3,059,337 A * 10/1962 Lynch ..... 33/32.3
3,273,249 A * 9/1966 Klaassen ..... 33/520
3,442,018 A * 5/1969 Viollet ..... 33/832
3,626,595 A * 12/1971 Hulen ..... 33/32.2
3,662,999 A * 5/1972 Meyer ..... 266/50
3,664,030 A * 5/1972 Pope, Jr. ..... 33/21.1
4,153,383 A * 5/1979 de Lanauze ..... 408/26
4,466,193 A * 8/1984 Astle ..... 33/21.1
4,553,327 A * 11/1985 Watanabe ..... 33/32.2
4,706,949 A * 11/1987 Dossey et al. ..... 269/283
5,164,009 A * 11/1992 Chandler ..... 118/13
5,224,269 A * 7/1993 Vale-Caban ..... 33/39.1
6,152,435 A * 11/2000 Snell ..... 269/43

(Continued)

FOREIGN PATENT DOCUMENTS

JP 60239667 A * 11/1985

*Primary Examiner*—R. Alexander Smith
(74) *Attorney, Agent, or Firm*—Nawrocki, Rooney & Sivertson, P.A.

(57) ABSTRACT

A tool for scribing a longitudinal groove on an elongate cylindrical rod suitable for implanting as a prosthetic in a living being supports the rod in a linear groove on a bed of a frame of the tool. A track is mounted on the frame and runs parallel to the groove. A carrier mounted on the track can slide on the track in constant spaced relation to and along the groove. A scribe mounted on the carrier extends toward the groove to contact a rod in the predetermined position. A preferred version of the tool has a clamp mounted on the bed for clamping the rod in the predetermined position. Additional features allow for precise angular positioning of the rod and for scribing a dashed line on the rod. In use, the tool operator places the rod in the predetermined position in the groove. The scribe is then pressed into contact with the rod. While the scribe is in pressed contact with the rod, the operator slides the carrier along the track.

19 Claims, 2 Drawing Sheets

U.S. PATENT DOCUMENTS 6,470,586 B1 * 10/2002 Kneipp ..... 33/529

2006/0064885 A1 * 3/2006 McKay et al. ..... 33/21.1

* cited by examiner

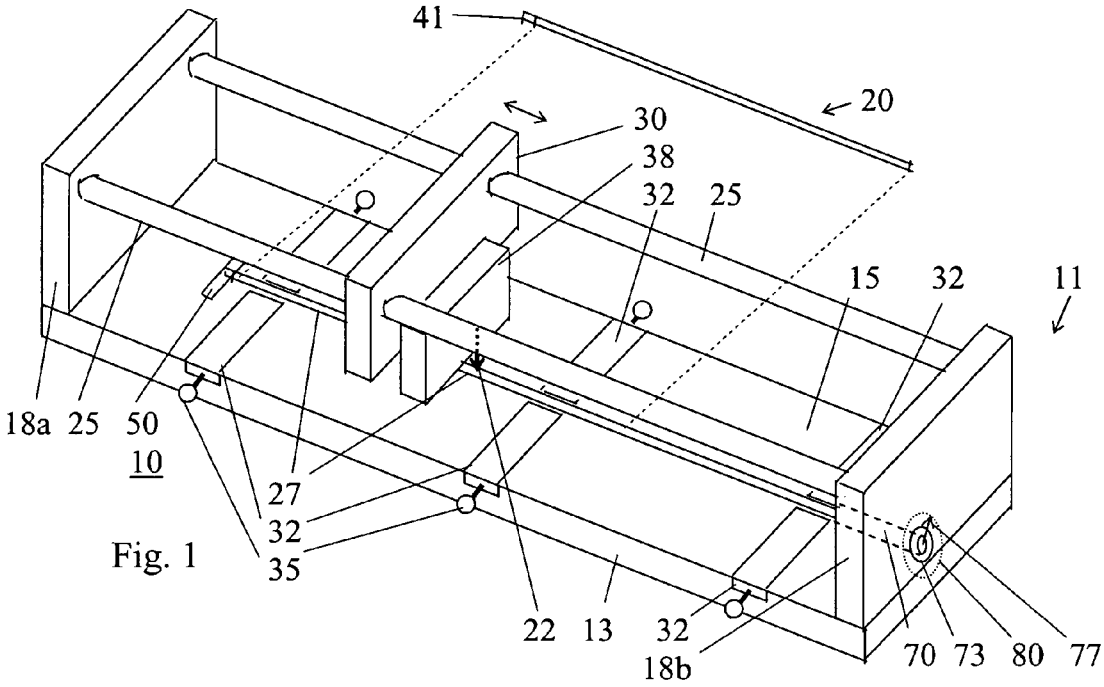
Fig. 1
Fig. 2
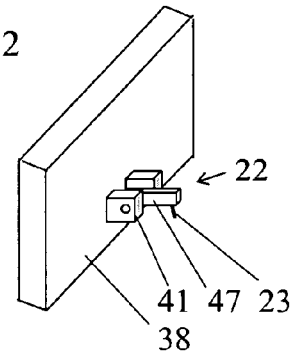
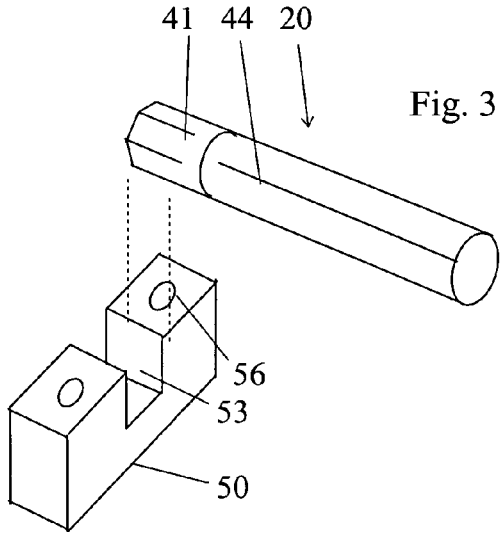
Fig. 3

TOOL AND METHOD FOR SCRIBING LONGITUDINAL LINES ON A CYLINDRICAL ROD

BACKGROUND OF THE INVENTION

Metal rods are used as orthopedic prostheses in a variety of applications. One particular application involves rods used as spinal prostheses. In this application, the rod is surgically implanted adjacent to the patient's spine and attached to individual vertebrae with screws, wires, etc. Titanium and stainless steel are most often used as the materials from which these metal rods are made.

When preparing to implant a prosthetic rod, the surgeon will frequently bend the rod to conform to the individual patient's physiological condition. After bending, it is important to be able to determine the angular orientation of the rod. Because the surface finish of these rods is uniform and without markings, surgeons sometimes in the past have had problems in determining the angular orientation of the rod during the implanting procedure.

Time spent determining the angular position of the rod during the surgery is undesirable. This extra time causes problems for the patient who must be in surgery for a longer time, and less importantly, reduces the surgeon's productivity. For this reason, it would be helpful to have markings on prosthetic rods to allow the surgeon to quickly determine the orientation of the rod after bending.

The industry has found it desirable to place a line or other marking the length of the rod to help determine the angular position of the rod. However, a suitable means to apply these markings has not been available.

SUMMARY OF THE INVENTION

The invention comprises a specialized tool for scribing a longitudinal linear mark on such an elongate cylindrical rod. The tool includes a frame made of a rigid material. The frame has a bed having a surface and ii) a linear groove on the bed extending for a predetermined distance and adapted to receive a rod in a predetermined position.

A track is mounted on the frame and runs parallel to the groove. A carrier is mounted on the track and slides on the track in constant spaced relation to and along the groove. A scribe mounted on the carrier extends toward the groove to contact a rod in the predetermined position.

A preferred version of the tool has a frame including a bed, with a groove in the bed. A clamp is mounted on the bed for clamping the rod in the predetermined position. Additional features allow for precise angular positioning of the rod and for scribing a dashed line on the rod.

In use, the tool operator places the rod in the predetermined position in the groove. The scribe is then pressed into contact with the rod. While the scribe is in pressed contact with the rod, the operator slides the carrier along the track.

BRIEF DESCRIPTION OF THE DRAWINGS

FIG. 1 is a perspective view of a tool for scribing a line on an elongate rod;

FIG. 2 shows the attachment of a scribing unit to a carrier forming a part of the tool;

FIG. 3 shows the component that controls orientation of the rod;

DETAILED DESCRIPTION OF THE INVENTION

Figure 4:
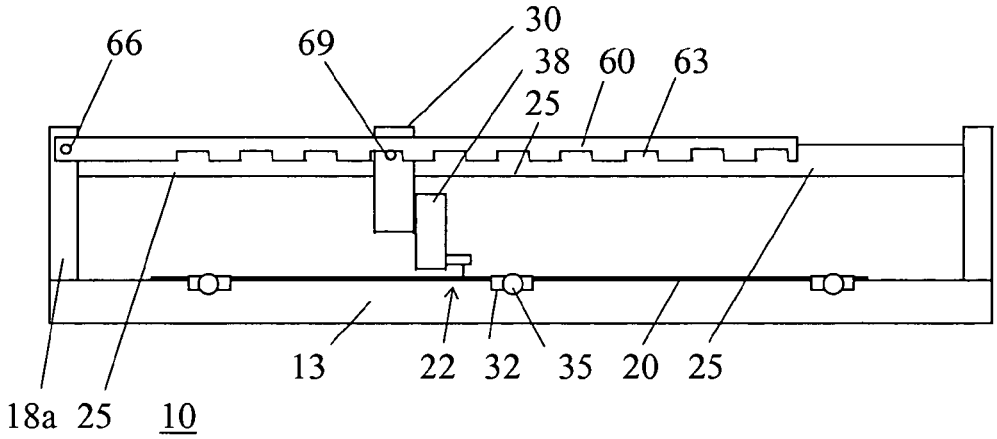
FIG. 4 is an elevation view of the side of the scribing tool, and showing apparatus for scribing a series of spaced dashes to comprise a line on the rod.

FIG. 1 shows a scribing tool 10 for scribing or marking a linear scratch or groove 44 along the length of a prosthetic rod 20 as shown in FIG. 4. Tool 10 comprises a frame 11 including an elongate bed 13 made of rigid material such as aluminum. Bed 13 has a flat surface 15 with a linear groove 27 machined therein extending along a substantial portion of the length of bed 13. Bed 13 may be in the range of 2–3 ft. long and 6–12 in. wide, depending on the maximum length of rod 20 to be scribed.

Frame 11 further includes a pair of track supports 18*a* and 18*b* made for example from aluminum and mounted on the ends of bed 13 to project at substantially right angles from flat surface 15 of bed 13. A pair of constant outer diameter round steel tubes or bars 25 are mounted between supports 18*a* and 18*b* to extend parallel to each other and form a guide track. The guide track can have other designs as well. One potential option is the traveler track units such as used in sailboats for adjusting sheets, which can be directly mounted on bed 13.

A carrier 30 is slidably mounted on tubes 25 with bearing holes through which tubes 25 pass. The bearing holes may have low friction inserts so that an operator can shift carrier 30 smoothly and easily along tubes 25.

A carriage block 38 is fastened to carrier 30 with convenient fasteners such as cap screws. A scribing unit 22 is fastened to block 38. In some embodiments, scribing unit 22 may be attached directly to carrier 30. Referring to FIG. 2, scribing unit 22 includes a stylus or scribe point 23 that creates the actual scribed mark 44 (FIG. 3) on rod 20. Scribing unit 22 is positioned on carrier 30 to place stylus 23 directly in the center of groove 27.

Groove 27 is adapted to receive a rod 20 to be scribed. A typical rod 20 has a rotational aid 41 comprising six walls forming a hexagonal cross section cylinder as shown in FIG. 3. Other shapes for rotational aid 41 such as a square cross section are suitable as well. The surgeon uses a special tool that fits on rotational aid 41 to rotate rod 20 to desired angular positions during implantation.

FIG. 3 shows an orienting element comprising an alignment fitting 50. Fitting 50 has a slot 53 to receive aid 41. The width of slot 53 should be chosen to closely match the spacing between opposing walls of rotational aid 41 to prevent relative rotation between fitting 50 and rod 20. Fitting 50 is mounted in bed 13 at the end of groove 27 and secured with cap screws passing through holes 56. When aid 41 is within slot 53, rod 20 cannot rotate with respect to fitting 50. Fitting 50 is designed to be relatively easily removable from bed 13 so that different widths of slots 53 can be provided to accommodate different sizes of aids 41.

A rod 20 preferably has two lines 44 scribed 180° apart. Fitting 50 allows lines 44 to be placed almost exactly 180° apart by simply reorienting rod 20 within slot 53.

To insure accurate and firm support for rod 20 within groove 27, tool 10 includes clamp jaws 32 that slide in wide transverse slots within bed 13. Jaws 32 are in horizontal alignment with groove 27, so that jaws 32 will bear directly on a rod 20 within groove 27. Handles 35 operate jackscrews that press jaws 32 against rod 20 lying in groove 27. Preferably, pairs of jaws 32 oppose to allow precise centering of rod 20 within groove 27 without bending rod 20. Jaws 32 should be limited strictly to transverse translation by guide elements as is well known in the machine tool arts.

In one embodiment, fitting 50 is omitted. The near end of rod 20 is temporarily clamped or otherwise attached to the far (left) end of a shaft 70 that extends toward and projects through a hole 73 in support 18*b*. A knob 77 is attached to the end of shaft 70 that allows angular orientation of rod 20 to be easily changed. Preferably, knob 77 includes a pointer that cooperates with an angle indicator or dial 80 carried on an outer surface of frame 11 to indicate the angular orientation of shaft 70. Of course, jaws 32 must not be clamping rod 20 while the operator is using knob 77 to change the angular orientation of rod 20.

FIG. 2 shows one embodiment for scribing unit 22. Brackets 41 support a stylus arm 47 having a top surface, and that pivots about a transverse axis on a shaft or pin. Preferably, arm 47 is spring-loaded to bias arm 47 counter-clockwise (as viewed in FIG. 2). Arm 47 carries a stylus or scribe element 23 at the projecting end of arm 47. Stylus 23 may be made of tool steel, carbide, or other hard material suitable for creating thin, (0.033–0.046 in., 0.84–1.17 mm.) visible lines on rods 20 made of titanium or stainless steel. During use, the operator, by pressing on the top surface of arm 47, pivots arm 47 clockwise to press stylus 23 against rod 20.

In use, the operator slides carrier 30 to the left against support 18*a* and places a rod 20 to be scribed with a line in groove 27. Next the operator turns handles 35 to securely clamp rod 20 within groove 27 with jaws 32. Experience shows that the operator can visually control the position of each jaw 32 to prevent excessive bending of rod 20.

Once rod 20 is secured in groove 27, the operator shifts carrier 30 to place stylus 23 directly above the point where the line 44 is to start. The operator smoothly strokes carrier 30 along the length of rod 20 while simultaneously maintaining downward force on arm 47. Typically, one to three strokes will create the desired width of line 44.

The operator can then loosen jaws 32 and rotate rod 20 to a new angle using either fitting 50 or knob 77. The scribing step described above is then repeated. When scribing is complete, the rod is polished and cleaned to prepare for implantation.

FIG. 4 shows a further embodiment of the invention. On occasion, a dashed line 44*a* shown in FIG. 5 may be required. A line 44*a* having regular and precise dashes can accurately indicate to the surgeon the depth of implantation of rod 20 and assist in any bending of rod 20 before implantation.

Figure 5:
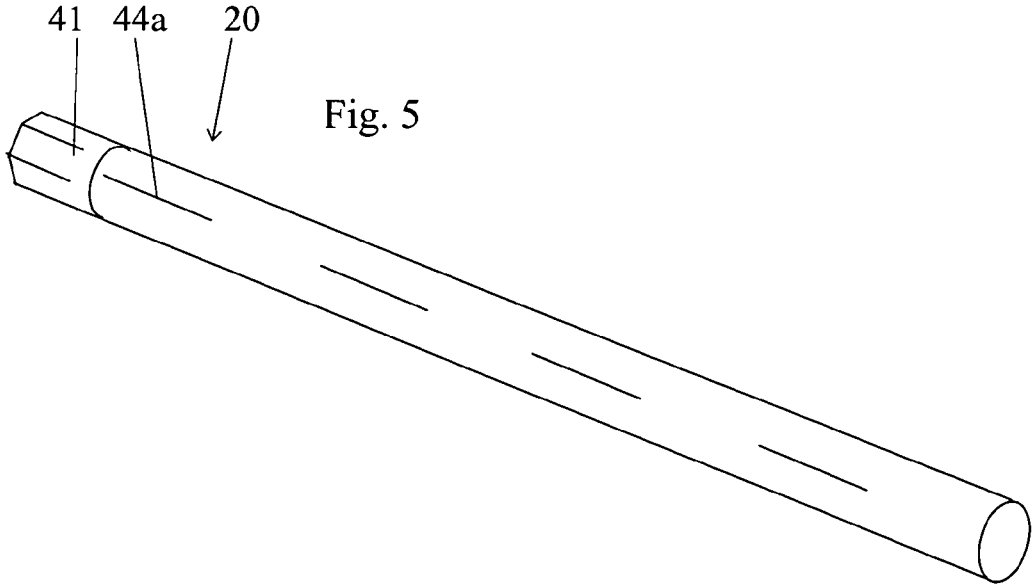
FIG. 5 shows a perspective view of a rod scribed with a series of spaced dashes.

For example, the line 44*a* on rod 20 as shown in FIG. 5 may have 25 mm. dashes spaced exactly 25 mm. apart. Using these dashes, a surgeon should be able to estimate to within 10 mm. or so, the distance between any two points on rod 20. On the other hand, the number of 25 mm. dashes will not be so great that the surgeon is likely to miscount the number of dashes between any two points on rod 20.

FIG. 4 shows an embodiment of tool 10 for limiting the sliding of carrier 30 to any of several predetermined ranges, to thereby allow an operator to easily and accurately form a line 44*a* comprising two or more dashes. A limit bar 60 has an end rotatably mounted on a vertical side edge of support 18*a* by a pin 66. Bar 60 has a series of equally spaced notches 63 on the downward-facing edge. A pin 69 projects from the vertical side edge of carrier 30. Any of the individual notches 63 in bar 60 can engage pin 69. Pin 69 should have a head to prevent bar 60 from falling out of engagement with pin 69. Each notch 63 limits shifting or sliding of carrier 30 when engaging pin 69 to a predetermined range equaling the width of notch 63 less the diameter of pin 69.

For example, suppose the operator desires 25 mm. dashes with 25 mm. spaces, and pin 69 has a diameter of 5 mm. Then the width of each notch 63 must be 25 mm. plus the diameter of pin 69, or 30 mm. The space between adjacent notches 63 must be 20 mm.

Obviously, bar 60 can be mounted on carrier 30 to achieve a similar function. However, this is less convenient in that the bar 60 then translates with carrier 30. When non-dashed lines 44 are to be formed, it is likely that the operator may wish to remove bar 60 from carrier 30, whereas a bar 60 mounted on support 18*a* can be simply rotated out of the way.

While the embodiment described above is preferred, many other embodiments can use the same concepts for positioning and securing rod 20. As just one example, bed 13 need not have a machined groove 27. Rather, the groove may be on the surface 15 and formed between a number of aligned clamp jaw pairs or between a pair of linear bars mounted on surface 15. The meaning of "groove" in this instance should be interpreted expansively.

Similarly, the function of other components of tool 10 can be provided in a variety of ways. In particular, a guide track can be formed in many ways besides the two tubes 25 shown, as previously discussed.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A tool for scribing a longitudinal groove on an elongate cylindrical rod having an axis extending the length of the rod, comprising:

a) a frame made of a rigid material, said frame having i) a surface, ii) a bed, and iii) a linear groove extending for a predetermined distance along the surface and adapted to receive the rod in a predetermined position;

b) a track mounted on the frame and running parallel to the groove;

c) a carrier mounted on the track and slidable thereon in spaced relation to and along the groove;

d) a clamp mounted on the bed for clamping the rod in the predetermined position, said clamp including a jaw in horizontal alignment with the groove; and e) a scribe mounted on the carrier and extending toward the groove to contact the rod in the predetermined position.

2. The tool of claim 1, wherein the clamp includes a pair of transversely aligned jaws.

3. The tool of claim 1, wherein the track comprises at least one bar spaced from the bed's surface and parallel to the groove and having a uniform cross section, and wherein the carrier has a bore conforming to the bar's cross section.

4. The tool of claim 3, having at least two of said bars extending above the bed and parallel to the groove and to each other, and straddling the groove, and wherein the carrier has two bores spaced and oriented to allow the carrier to slide along the two bars.

5. A tool for scribing a longitudinal groove on an elongate cylindrical rod having an axis extending the length of the rod, comprising:

a) a frame made of a rigid material, said frame having i) a surface and ii) a linear groove extending for a predetermined distance alone the surface and adapted to receive the rod in a predetermined position:

b) a track mounted on the frame and running parallel to the groove;

c) a carrier mounted on the track and slidable thereon in spaced relation to and along the groove; and d) a scribe mounted on the carrier and extending toward the groove to contact the rod in the predetermined position, wherein the carrier includes a pivoting arm carrying the scribe and mounted on the carrier to pivot from a first position with the scribe spaced from the rod in the predetermined position to a second position with the scribe contacting the rod in the predetermined position.

6. The tool of claim 5, wherein the pivoting arm is spring-biased to return to the first position, and wherein the arm has a surface accessible to a human for manually pivoting the arm into the second position while the carrier slides along the track.

7. The tool of claim 6, wherein the arm has a surface accessible to a human, said arm and arm surface allowing a human to manually pivot the arm into the second position and then slide the carrier along the track.

8. A tool for scribing a longitudinal groove on an elongate cylindrical rod having an axis extending the length of the rod, comprising:

a) a frame made of a rigid material, said frame having i) a surface and ii) a linear groove extending for a predetermined distance alone the surface and adapted to receive the rod in a predetermined position;

b) a track mounted on the frame and running parallel to the groove;

c) a carrier mounted on the track and slidable thereon in spaced relation to and along the groove;

d) a scribe mounted on the carrier and extending toward the groove to contact the rod in the predetermined position; and e) an orienting element for controlling the angular orientation of the rod in the predetermined position.

9. The tool of claim 8, wherein the rod has a rotational aid, and wherein the orienting element comprises an alignment fitting for receiving an end of the rod, said fitting having a groove having at least two facing flat surfaces, and wherein the fitting is adjacent to and in alignment with the end of the groove.

10. The tool of claim 9, for use where the rod has at least two oppositely facing flat sides integral with the rod, and wherein the bed has an orientation surface for mating with either of the flat sides.

11. The tool of claim 9, wherein the carrier includes a pivoting arm carrying the scribe and mounted on the carrier to pivot from a first position with the scribe spaced from a rod in the predetermined position to a second position with the scribe contacting a rod in the predetermined position, and approximately midway from the groove sides, wherein the pivoting arm is spring-biased to return to the first position, and wherein the arm has a surface accessible to a human for manually pivoting the arm into the second position while sliding the carrier along the track.

12. A method for using the tool of claim 11, comprising the steps of:

a) placing the rod in the predetermined position in the groove;

b) pivoting the arm into the second position with the scribe pressing against the rod; and c) while the scribe is pressed against the rod, sliding the carrier along the track.

13. The method of claim 12, including the step after placing the rod in the predetermined position in the groove and before pivoting the arm into the second position, of rotating at least one handle to force a clamp jaw toward the groove and against the rod.

14. The method of claim 13, for use with a rod including an orienting element for controlling the angular orientation of the rod while in the predetermined position including the steps after sliding the carrier along the track, including the steps of:

d) moving the clamp jaw away from the rod;

e) rotating the rod about its length to a different angular position;

f) placing the rotated rod in the predetermined position;

g) moving the clamp jaw against the rod; and h) repeating the arm-pivoting and carrier-sliding steps.

15. The tool of claim 8, wherein the orienting element comprises a shaft attached to an end of the rod, said shaft having a knob for adjusting the angular position of the rod.

16. The tool of claim 15, including a dial carried by the bed for cooperating with the knob to indicate the angular position of the rod.

17. A tool for scribing a longitudinal groove on an elongate cylindrical rod having an axis extending the length of the rod, comprising:

a) a frame made of a rigid material, said frame having i) a surface and ii) a linear groove extending for a predetermined distance along the surface and adapted to receive the rod in a predetermined position;

b) a track mounted on the frame and running parallel to the groove;

c) a carrier mounted on the track and slidable thereon in spaced relation to and along the groove;

d) a scribe mounted on the carrier and extending toward the groove to contact the rod in the predetermined position; and e) a limit bar connecting the carrier and the frame for restricting the sliding of the carrier to a predetermined range.

18. The tool of claim 17, wherein the limit bar is pivoted on one of the carrier and the frame, and has at least one downwardly facing notch to receive and interact with a pin mounted on the other of the carrier and the frame.

19. A rod manufactured with the use of the tool of claim 17, said rod having a line scribed thereon comprising at least two spaced dashes.

* * * * *